US011090226B2

(12) United States Patent
Dubaele et al.

(10) Patent No.: US 11,090,226 B2
(45) Date of Patent: Aug. 17, 2021

(54) SEALING DEVICE FOR MAKING IT POSSIBLE TO COLLECT A COMPOSITION, PACKAGING ASSEMBLY COMPRISING SUCH A SEALING DEVICE, COLLECTION AND PACKAGING METHODS

(71) Applicant: CENTRE HOSPITALIER UNIVERSITAIRE D'AMIENS-PICARDIE, Amiens (FR)

(72) Inventors: Jean-Marc Dubaele, Amiens (FR); Thierry Guillemaut, Beaune-le-Chaud (FR)

(73) Assignee: CENTRE HOSPITALIER UNIVERSITAIRE D'AMIENS-PICARDIE, Amiens (FR)

( * ) Notice: Subject to any disclaimer, the term of this patent is extended or adjusted under 35 U.S.C. 154(b) by 394 days.

(21) Appl. No.: 15/567,220

(22) PCT Filed: Apr. 14, 2016

(86) PCT No.: PCT/EP2016/058194
§ 371 (c)(1),
(2) Date: Oct. 17, 2017

(87) PCT Pub. No.: WO2016/166197
PCT Pub. Date: Oct. 20, 2016

(65) Prior Publication Data

US 2018/0104150 A1 Apr. 19, 2018

(30) Foreign Application Priority Data

Apr. 17, 2015 (FR) ..... 1553442

(51) Int. Cl.
*A61J 1/20* (2006.01)
*A61J 3/00* (2006.01)
(Continued)

(52) U.S. Cl.
CPC ..... *A61J 1/2051* (2015.05); *A61J 1/2075* (2015.05); *A61J 1/2082* (2015.05); *A61J 1/2096* (2013.01);
(Continued)

(58) Field of Classification Search
CPC ..... A61J 1/1418; A61J 1/1412; A61J 1/2051; A61J 1/2075; A61J 1/2096; B65D 41/04; B65D 50/046
See application file for complete search history.

(56) References Cited

U.S. PATENT DOCUMENTS 3,654,926 A * 4/1972 Rietman ..... A61J 1/2093 604/416
4,230,112 A * 10/1980 Smith ..... A61J 1/2096 141/311 R
(Continued)

FOREIGN PATENT DOCUMENTS

EP 0 960 616 A2 1/1999
EP 2 266 523 A1 12/2010
(Continued)

OTHER PUBLICATIONS

International Search Report from the European Patent Office in International Application No. PCT/EP2016/058194 dated Dec. 7, 2016.
(Continued)

*Primary Examiner* — Catharine L Anderson
*Assistant Examiner* — Arjuna P Chatrathi
(74) *Attorney, Agent, or Firm* — The Marbury Law Group, PLLC

(57) ABSTRACT

The present invention relates to a sealing device to seal a container, the sealing device including: a tip that defines an internal passage leading to an opening and is designed to allow connection to a collection member such as an enteral
(Continued)

Figure 1:
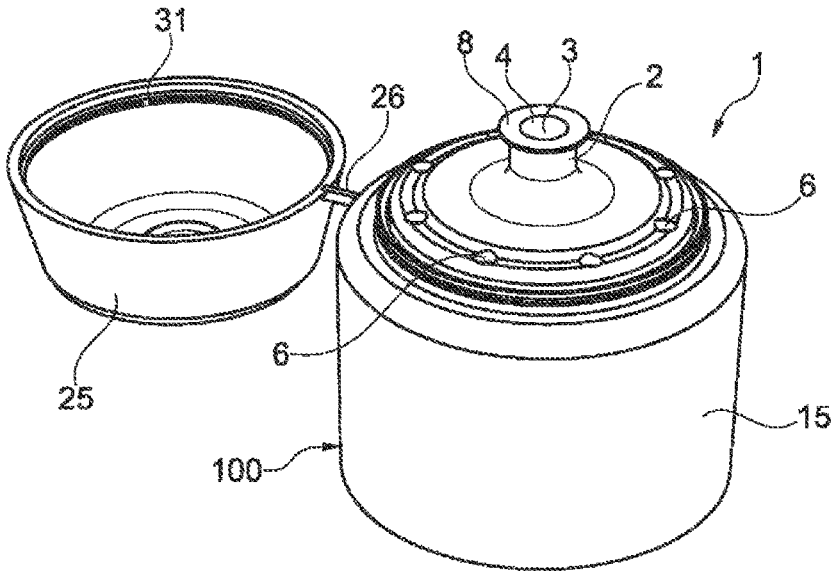

syringe, a non-return valve that is associated with the tip and is designed to open during collection of the contents of the container using the collection member, at least one air-return port, and an antibacterial filter associated with said at least one port.

20 Claims, 4 Drawing Sheets

(51) Int. Cl.
*A61J 1/06* (2006.01)
*A61J 1/14* (2006.01)
*B65D 1/00* (2006.01)
*B65B 7/00* (2006.01)

(52) U.S. Cl.
CPC ..... *A61J 3/002* (2013.01); *B65B 7/00* (2013.01); *B65D 1/00* (2013.01); *A61J 1/065* (2013.01); *A61J 1/1425* (2015.05); *A61J 1/1481* (2015.05)

(56) References Cited

U.S. PATENT DOCUMENTS

| | | | | | |
|---|---|---|---|---|---|
| 4,493,348 | A * | 1/1985 | Lemmons | A61J 1/2096 | 141/1 |
| 4,614,515 | A | 9/1986 | Tripp et al. | | |
| 4,743,243 | A * | 5/1988 | Vaillancourt | A61J 1/2096 | 604/126 |
| 5,702,019 | A * | 12/1997 | Grimard | A61J 1/2096 | 141/24 |
| 6,139,534 | A * | 10/2000 | Niedospial, Jr. | A61J 1/2096 | 604/403 |
| RE37,243 | E * | 6/2001 | Molinaro | B65D 41/3409 | 215/256 |
| 7,635,344 | B2 * | 12/2009 | Tennican | A61J 1/2096 | 604/88 |
| 8,651,305 | B1 * | 2/2014 | Lunn | B65D 51/002 | 215/244 |
| 2009/0254031 | A1 * | 10/2009 | Lee | A61J 1/2096 | 604/83 |
| 2011/0168292 | A1 * | 7/2011 | Luzbetak | A61J 9/00 | 141/2 |
| 2013/0218121 | A1 * | 8/2013 | Waller | A61M 39/24 | 604/403 |

FOREIGN PATENT DOCUMENTS

| | | | |
|---|---|---|---|
| EP | 2 601 987 | A1 | 6/2013 |
| FR | 2 870 827 | A3 | 12/2005 |
| FR | 2 928 539 | A1 | 9/2009 |
| FR | 2993174 | A1 | 1/2014 |
| JP | 3-500608 | A | 2/1991 |
| JP | 2001-513683 | A | 9/2001 |
| JP | 2011-212361 | A | 10/2011 |
| JP | 2015-506255 | A | 3/2015 |
| WO | 89/00836 | A1 | 2/1989 |
| WO | 98/37855 | A1 | 9/1998 |
| WO | 02/11794 | A1 | 2/2002 |
| WO | 2002/011794 | A1 | 2/2002 |
| WO | 2004/043326 | A1 | 5/2004 |
| WO | 2011/027207 | A1 | 3/2011 |
| WO | 2012/061353 | A1 | 5/2012 |
| WO | 2013/115731 | A1 | 8/2013 |

OTHER PUBLICATIONS

Japanese Office Action cited in related Patent Application No. 2018-505531 filed Jan. 21, 2020.

Japanese Office Action cited in related Patent Application No. 2018-505531 dated Aug. 4, 2020.

* cited by examiner

SEALING DEVICE FOR MAKING IT POSSIBLE TO COLLECT A COMPOSITION, PACKAGING ASSEMBLY COMPRISING SUCH A SEALING DEVICE, COLLECTION AND PACKAGING METHODS

CROSS REFERENCE TO RELATED APPLICATION

This is a national stage application of PCT/EP2016/058194, filed internationally on Apr. 14, 2016, which claims priority to French Application No. 1553442, filed on Apr. 17, 2015, which applications are incorporated by reference herein in their entireties.

The present invention relates to a sealing device allowing the collection, with a view to administration by enteral or nasal routes or for topical use, of compositions in the pharmaceutical, cosmetics and food sectors. The invention also relates to a packaging assembly comprising a sealing device of this type and also methods for packaging and collecting compositions.

Syrups or solutions to be taken orally, packaged in multi-dose vials with a screw stopper are known. Upon opening of the vial, the exterior air penetrates the container and contaminates the contents.

It is thus necessary for antimicrobial preservatives to be added to the liquid solutions thus packaged. The principal antimicrobial preservatives approved and used for liquid forms are alcohol, benzoic acid and parabens. Alcohol and benzoic acid may not be used in all liquid formulations, particularly in pediatric preparations or for treating persons suffering from a liver complaint. There remain, therefore, parabens, which are already widely added to pharmaceutical, cosmetic and food products. In point of fact, a potential accumulation of such parabens in the body could give rise to hormonal disturbances. The use of parabens is nowadays controversial. The current trend is therefore to eliminate preservatives from all products, particularly those intended for children or for persons in whom preservatives are contra-indicated. However, in the absence of an approved alternative, the use of such antimicrobial preservatives is still current.

There is thus a need to eliminate or to reduce the one or more preservatives in compositions in the pharmaceutical, food and cosmetics sectors.

To that end, it is known to produce single-dose receptacles for the distribution of compositions. However, this solution gives rise to greater waste and requires more manpower and packaging.

International application WO2004/043326 describes a bottleneck liner dimensioned so as to be affixed in a sealed manner in the neck of the bottle and comprising a liner defining an insert allowing securing to a syringe tip in order to perform collection. Nevertheless, the ingress of potentially contaminated ambient air is not prevented by a sealing device of this type. Moreover, it is still possible to inject a potentially contaminated liquid into the bottle.

EP 0 960 616 describes an elastomeric closure designed to be inserted in the neck of a vial and comprising a sealing membrane capable of self-sealing.

FR 2 870 827 describes a distribution member placed in the opening of a vial, comprising an insert equipped with a port allowing the insertion of a syringe into the insert, collection of a solution contained in the vial through the port and then withdrawal of the syringe.

U.S. Pat. No. 4,614,515 describes a sealing device of a vial allowing, in particular, collection of the contents using a needle syringe for parenteral administration.

FR 2 928 539 describes an interface device intended for connecting a needle syringe for parenteral administration and a vial to be perforated containing a medicinal product.

FR 2 993 174 relates to a device for allowing secure distribution of a liquid contained in a vial, comprising a section reducer having a first port capable of receiving a syringe, an intermediate component having a second port and intended to cap the section reducer such that said first and second ports are located opposite one another, and a closure means of the first and/or second ports.

EP 2 266 523 describes a vial adapter comprising a valve that may occupy an open position allowing communication between a syringe and the interior of the vial in order to allow the introduction of a liquid inside the vial or the collection of liquid from the vial, and a closed position preventing any fluid communication.

WO 2012/061353 describes a system for filling a fluid into vials and for distributing fluid from vials, comprising two different valves, each being adapted for one of these two functions.

WO 2011/027207 relates to a device for connection between different medical accessories in order to allow and to control the transfer of fluid from one accessory to another.

EP 2 601 987 discloses a device comprising two non-return valves permitting connection between a vial, a syringe and a catheter.

To respond in full or in part to the aforesaid needs, the present invention proposes a sealing device for collecting a composition intended for enteral or nasal administration or for topical use, contained in a receptacle, characterized by the fact that it comprises:

- a tip defining an internal passage leading to an opening designed to allow a connection to a collection member such as an enteral syringe, a non-return valve associated with said tip, designed in order to open upon collection of the contents of the receptacle using the collection member,
- at least one air-return port, and
- an antibacterial filter associated with said air-return port.

By virtue of the invention, contamination of the composition contained in the receptacle is avoided, which makes it possible to prevent or to reduce the use of preservatives in the compositions, particularly those intended for children or for persons having a pathological condition such as a liver condition or an allergy.

"Composition" is understood to mean any liquid solution, emulsion, semi-liquid solution, colloidal solution or semi-pasty product, in particular a gel, intended for pharmaceutical, food or cosmetic use.

The air-return port allows the ingress of air into the receptacle, in particular simultaneously with a collection of composition in the receptacle.

The tip may have at least partially a substantially conical form, in particular with an approximately 6% taper, being preferably of the "lockable standardized cone" or "luer lock cone" type.

The tip advantageously constitutes a secure and sealed connection member for a member for collecting a composition intended for enteral administration or for topical use. The collection member may be screwed on to the tip in such a manner as to make the connection between collection member and sealing device secure and to seal it. In this case, the tip comprises means allowing the fastening, in particular the screwing of the collection member, by means of an external or internal screw thread. Compatibility with just the members for collection and enteral administration or topical use makes it possible to avoid the risk of collecting a solution for oral or other administration, which has to be sterile, using a syringe for parenteral administration.

The non-return valve may comprise a seat and a sealing membrane resting on said seat and may have an annular form. It may comprise an annular reduction, on the sealing membrane, to facilitate its deformation. The sealing membrane may be produced from a polymeric material, in particular a flexible polymeric material, used in the manufacture of devices for medical, food or cosmetic use, for example an elastomeric or silicone material. When a pressure drop is exerted on the non-return valve, for example by a piston of the collection member when secured to the tip, the sealing membrane moves away from the seat and allows the passage of liquid.

The filter may be produced from a hydrophobic material, with the aim of reducing bacterial contamination, having, for example, a mean pore diameter of less than 0.3 μm, for example equal to 0.22 μm.

The sealing device according to the invention may comprise a plate intended to be in contact with the interior of the receptacle and having at least one perforation for the passage of air and at least one perforation for the passage of liquid.

The filter may thus cover said at least one perforation for the passage of air and may be affixed, in particular by gluing or welding, to said plate. The non-return valve may be positioned on the plate so as to close off said at least one perforation for the passage of liquid.

The sealing device according to the invention may comprise means for fastening on the receptacle. These fastening means may comprise a fastening skirt, in particular a skirt with an internal thread, arranged in order to be affixed to a neck of the receptacle, by screwing and/or snap-fitting. The fastening means may comprise a tamper-evident relief designed to prevent removal of the sealing device from the receptacle once said device has been secured to the receptacle. The fastening means advantageously comprise a sealing skirt arranged in order to come into interior sealed contact with the neck of the receptacle.

The sealing device according to the invention may comprise a closure member, the closure member being preferably connected to the remainder of the sealing device by a flexible link, such as a film hinge. The closure member, which may form a cap, makes it possible to close the sealing device and, in particular, to close the tip and the one or more air-return ports.

The closure member may be equipped with a tamper-evident system ("tamper-evident means"), providing proof that the device and thus the composition has never been used.

The sealing device according to the invention may comprise an upper part and a lower part assembled together, in particular by snap-fitting, said upper and lower parts together defining, when assembled, a zone for the passage of air, an intermediate zone for holding the non-return valve, and a zone for the passage of liquid.

The upper part may comprise the tip and said at least one air-return port. It may comprise, on an internal face, a sealing lip intended to bear on the non-return valve, particularly on said annular reduction of the non-return valve. The upper part allows fastening of the collection member.

The lower part may comprise the plate. It is preferably in at least partial contact with the composition and may be fastened on the vial comprising the means for fastening to the receptacle.

The sealing device overall is advantageously produced from thermoplastics, by injection-molding, it being possible for the lower part and the closure member to be produced as a single component.

A further subject of the present invention, in combination with the aforesaid, is a packaging assembly for a composition intended for enteral administration or for topical use, comprising a receptacle for packaging said composition, secured to a sealing device as defined above. An assembly of this type may further comprise at least one collection member, which is advantageously designed in order to allow enteral or topical administration. This assembly may be packaged in a totally or partially sterile or non-sterile individual package, the receptacle being filled with the composition to be dispensed.

The invention makes it possible to reduce the costs of manufacture as compared with single-dose vials. The invention also makes it possible to increase the storage life of the composition after the first opening of the receptacle. The preservative concentration in the composition may thus be reduced, and even eliminated.

Owing to the sealing achieved at various levels, namely the link between the sealing device and the receptacle on the one hand, within the sealing device itself, and in the interface between the collection member and the sealing device, leakages of liquid outside the receptacle upon collection may be avoided, which enhances hygiene at the time of use.

A further subject of the present invention, in combination with the aforesaid, is a method for collecting a composition using a collection member such as an enteral syringe in a receptacle equipped with a sealing device as defined above, comprising the following steps:

- securing the collection member to the tip,
- collecting the required quantity of composition with the collection member, particularly using a piston of a syringe,
- removing the collection member from the tip,
- repeating the above steps if necessary and as many times as is necessary.

When the sealing device comprises a closure member, the method may comprise the steps consisting in opening the closure member before securing the collection member to the tip and in closing the closure member after removal of the collection member.

A further subject of the invention, in combination with the aforesaid, is a method for packaging, in a receptacle, a composition intended for enteral administration or for topical use, comprising the following steps:

- placing said composition in the receptacle,
- fastening a sealing device as defined above to the receptacle.

This packaging method may comprise the steps consisting in associating at least one collection member such as a syringe with said receptacle and, optionally, in arranging the whole in a sterile or non-sterile individual package.

Figure 2:
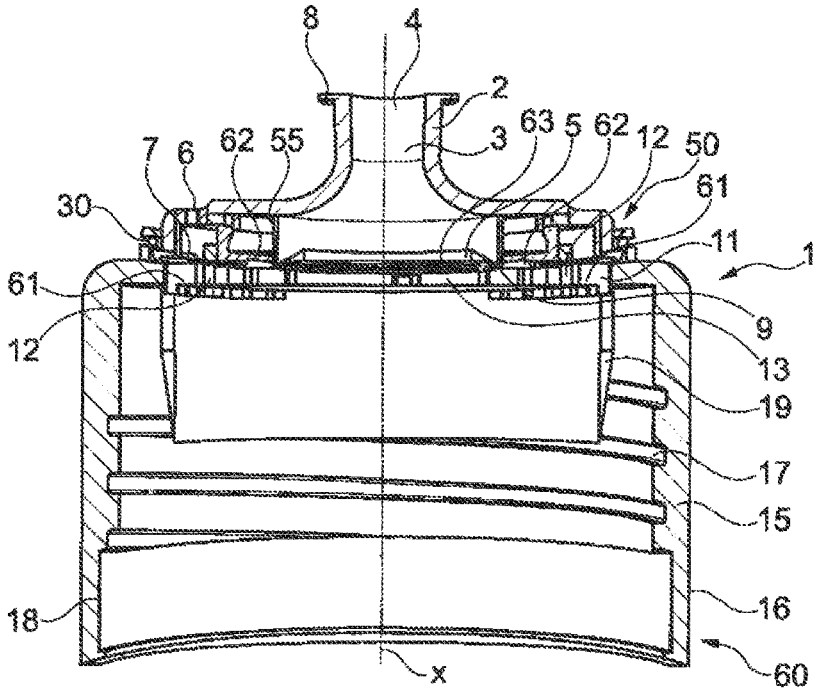
Figure 3:
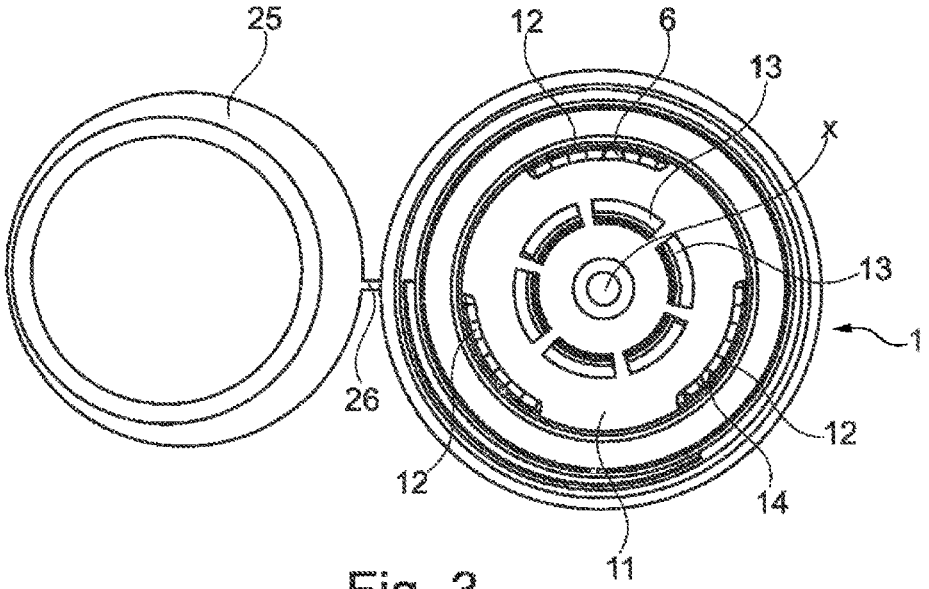
Figure 4:
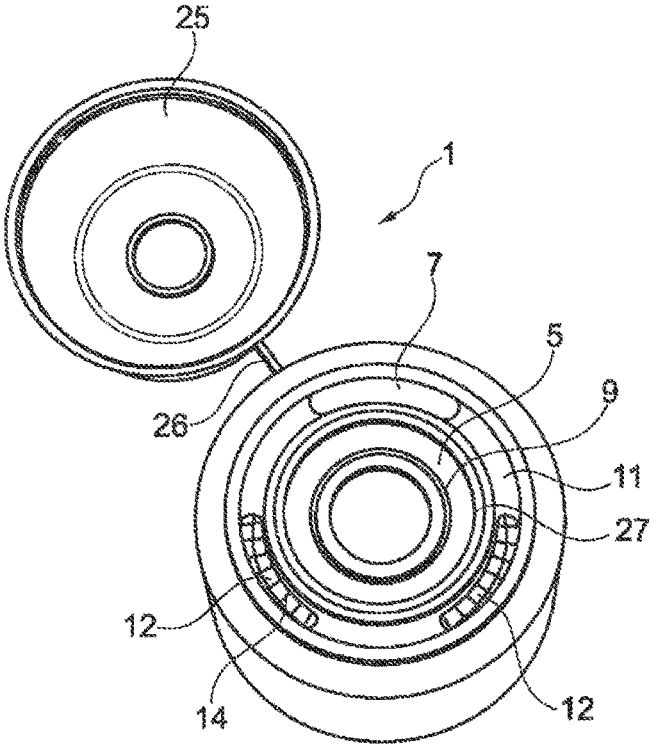
Figure 5:
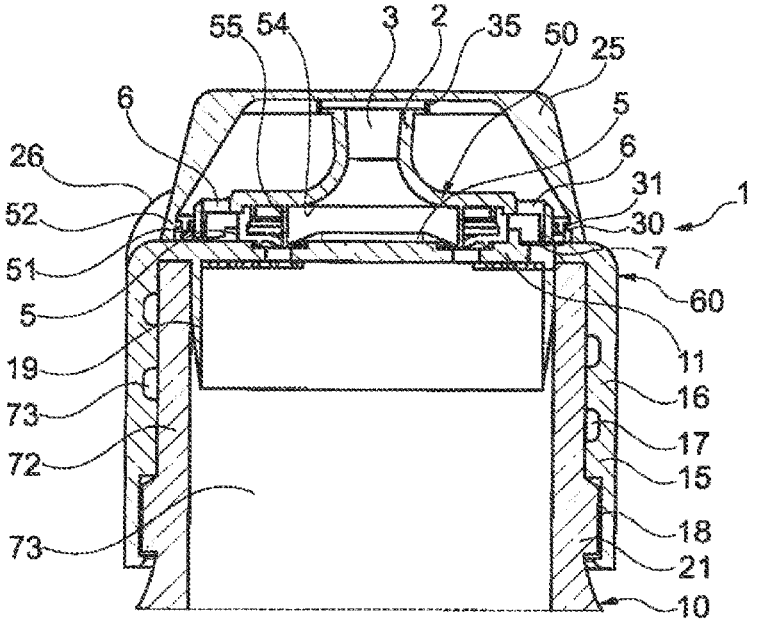
Figure 6:
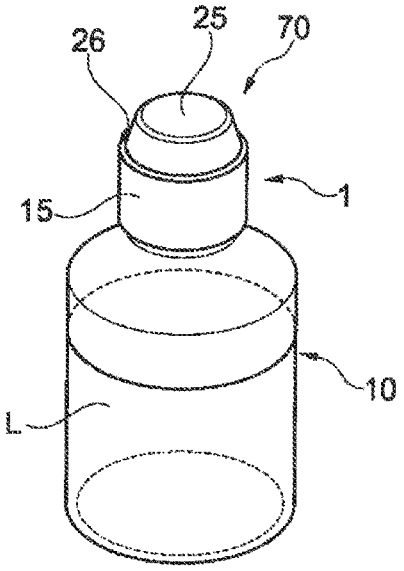
Figure 7:
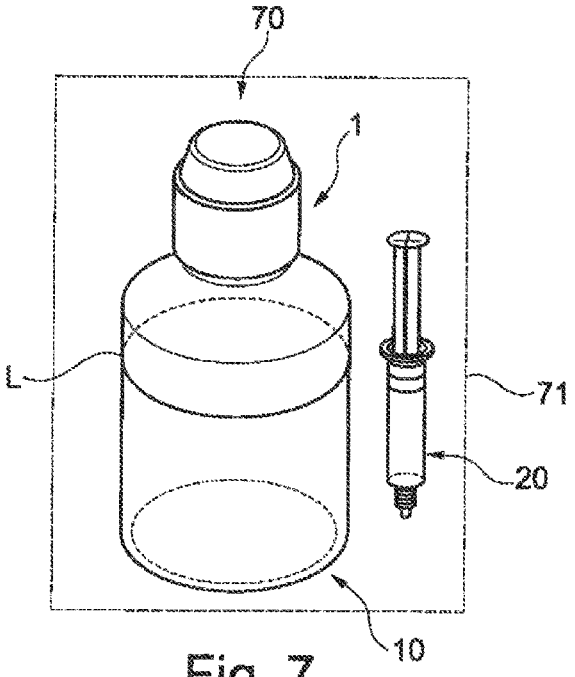
Figure 8:
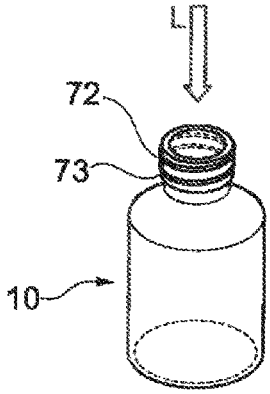
Figure 9:
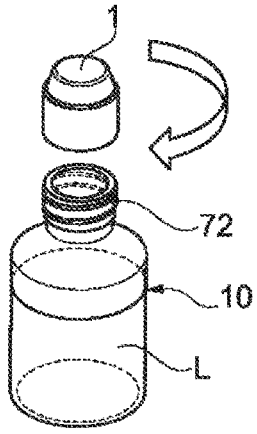

The invention may be better understood on reading the following detailed description of a non-limiting illustrative embodiment thereof and on examining the appended drawing, in which:

FIG. 1 shows, schematically and in perspective, an example of a sealing device according to the invention, FIG. 2 shows, in axial, schematic and partial section, the sealing device of FIG. 1, FIG. 3 shows, schematically in bottom view, the sealing device of FIG. 1, FIG. 4 shows, schematically in top view, the sealing device of FIG. 1, the upper part removed, FIG. 5 shows, in axial section, schematically and in part, the sealing device of FIG. 1, closed and fastened on the neck of a receptacle, FIG. 6 shows, schematically and in perspective, the receptacle equipped with the sealing device of FIG. 1, closed, FIG. 7 shows, schematically, a packaging assembly comprising the receptacle of FIG. 6 and an adapted collection member, FIGS. 8 and 9 show, schematically, two steps in a method for packaging a composition in a receptacle closed by a sealing device according to the invention, and FIGS. 10 to 13 illustrate, schematically, steps in a method for collecting a composition using the sealing device according to the invention.

The sealing device 1, shown in FIGS. 1 to 5, is intended to be fastened to a receptacle 10, which may be seen, in particular, in FIG. 5 or 6. This receptacle 10 contains a composition for enteral administration or for topical use, the preservative concentration of which is lowered or even zero.

The sealing device 1 comprises a dispensing tip 2 defining an internal passage 3 extending along a longitudinal axis X. The internal passage 3 leads to an opening 4 forming the free end of the tip 2. The latter is designed to allow a connection to a collection member, such as an enteral syringe 20, which may be seen in FIG. 7.

The sealing device 1 further comprises a non-return valve 5 associated with the tip 2, designed to open upon collection of the contents of the receptacle using the collection member, which may be seen in particular in FIGS. 2, 4 and 5. The non-return valve 5 prevents any return of fluid to the interior of the receptacle and also prevents the ingress of air in the absence of a collection member.

The sealing device 1 also comprises at least one air-return port 6, of which there are nine in this example. At least one antibacterial filter 7, aimed at reducing bacterial contamination, is associated with the ports 6. A filter 7 of this type makes it possible systematically to filter the air entering the receptacle via the ports 6, preventing contamination of the composition contained in the receptacle. Thus, by virtue of the invention, it is possible to perform a multiple-dose collection or multiple collections of a composition contained in a receptacle via the sealing device 1 without contaminating the composition remaining in the receptacle, preventing the return of potentially contaminated composition to the interior of the receptacle and by virtue of the filtration of any air entering the receptacle owing to the reduced pressure created upon collection of the solution.

The ports 6 are, for example, each of circular form.

In the example illustrated, the tip 2 has at least in part a substantially conical form about the longitudinal axis X, being slightly flared toward the exterior closer to its opening 4, as may be seen in FIG. 2. The taper may be approximately 6%. In particular, the tip 2 may be a "lockable standardized cone" or "luer lock cone" tip, the latter form with a locking collar 8 further allowing locking of the collection member in the tip 2, in a manner known per se.

The non-return valve 5 is composed of a sealing membrane 27 made from a flexible polymeric material, for example an elastomeric or silicone material, having an annular form about the axis X, as may be seen in particular in FIG. 4. An annular reduction 9 facilitates deformation thereof in the axis X of the receptacle.

The filter 7 is advantageously made from a hydrophobic material, so as to prevent the exit of liquid via the ports 6. The filter 7 has, for example, a mean pore diameter less than 0.3 μm.

In the sealing device 1 illustrated, the latter comprises, as may be seen more particularly in FIG. 3 or 5, a plate 11 intended to be in contact with the interior 73 of the receptacle and having at least one perforation 12 for the passage of air and at least one perforation 13 for the passage of liquid. In the example illustrated, the perforations 12 and 13 are distributed annularly about the central axis X, the perforations 12 forming ring portions located radially at the exterior relative to the perforations 13, arranged, also, in a ring portion about the longitudinal axis X. In this example, the number of perforations 13 is six, it being possible for this number to be reduced or increased without departing from the scope of the invention, particularly to be between three and six, so as to permit the passage of air without having to exert an excessive pulling force on the syringe at the time of collection. The number of perforations 12 is three, each perforation 12 having separations 14 that may play a part in holding the underlying filter 7.

In this example, the filter 7 or the filters 7, covers (cover) the perforations 12 for the passage of air and are affixed, particularly by gluing or welding, to the plate 11. A filter 7 is shown in FIG. 4. The filter 7 may be a single filter and have an annular form of diameter and dimensions such that it covers all the perforations 12 for the passage of air. In a variant, the filters may be three in number, as in this example, a single filter 7 being shown, however, in FIG. 4. Each filter 7 covers a perforation 12 for the passage of air.

The angular extent of the perforations 12 for the passage of air is sufficient for the perforations to be at least partially superposed over at least a portion of the ports 6.

The upper and lower parts together delimit an annular chamber where air is able to circulate between the ports 6 and the perforations 12 at the time of air return.

The sealing membrane 27 is in this example positioned on the plate 11 so as, at rest, as may be seen in FIG. 4, to close off the perforations 13. The central portion, of discoid form, of the plate 11 thus forms the seat of the non-return valve 5. The sealing membrane is advantageously glued, in particular using ultrasound.

In the example illustrated, the sealing device 1 further comprises means 15 for fastening on the receptacle. The fastening means 15 may comprise, as illustrated, a fastening skirt 16 having an internal thread 17 arranged in order to be fastened to an externally threaded neck of the receptacle, as may be seen in FIG. 5.

The fastening means 15 advantageously comprise a tamper-evident relief 18, which may be seen in FIGS. 2 and 5, designed to prevent removal of the sealing device 1 from the receptacle 10 once it has been secured to the receptacle. As may be seen in FIG. 5, this tamper-evident relief may have the form of an annular flute, and the receptacle 10 may, meanwhile, comprise a catching bead 21 that complements the tamper-evident relief 18, over which the flute snap fits upon completion of the screwing of the fastening means.

The fastening means 15 further comprise a sealing skirt 19 capable of coming into sealed internal contact with the neck of the receptacle, as may be seen in particular in FIG. 5.

The sealing device 1 according to the invention also comprises a closure member 25, the role of which is to close the opening 4 of the tip 2 in a sealed manner. In the example illustrated, the closure member 25 consists in a cap connected by a flexible link 26, such as a film hinge, to the base 100 of the sealing device. The closure member 25 comprises a sealing lip 35 capable of forming the seal around the opening 4 of the tip 2 in order to prevent any leakage when the sealing device 1 is closed. A tamper-proof system, which is not shown in the figures to improve the clarity of the drawing, is also provided.

At its periphery, on its interior surface, the cap has an annular bead 31 capable of snap-fitting into a corresponding flute 30 of the base 100, provided on an upright forming a projection around the air-return ports 6.

The base 100 comprises an upper part 50 and a lower part 60 assembled together, in this example by snap-fitting using complementary snap-fitting reliefs 51 and 52, formed, respectively, on the upper 50 and lower 60 parts, in a circular form in a peripheral region of said parts. When assembled, the upper 50 and lower 60 parts together define three distinct zones. A first, exterior zone 61 defines the aforesaid annular chamber that allows the passage of air. A second, intermediate zone 62, which is likewise annular, allows holding of the non-return valve 5, and a third zone 63, which is substantially cylindrical, allows the passage of liquid. The intermediate zone 62 prevents any communication between the zones 61 and 63.

In this example, the upper part 50 of the sealing device comprises the tip 2 and the air-return ports 6. As may be seen in particular in FIG. 2, the upper part 50 comprises, on an internal face 54, a sealing lip 55 bearing on the sealing membrane 27 of the non-return valve 5, on the annular reduction 9. When a reduced pressure is exerted, only the part 4 radially inside this annular reduction of the membrane 27 is deformed. The dimensions of the upper part may be optimized so as to avoid the stagnation of liquid and to prevent contamination at the time of the subsequent collection.

The lower part 60 comprises the plate 11 and also the means 15 for fastening to the receptacle.

FIG. 5 shows the neck 72 of the receptacle 10 having an external screw thread 73, which enables it to interact with the internal screw thread 17 of the fastening skirt 16 of the sealing device 1.

FIGS. 6 and 7 show an example of a packaging assembly 70 according to the invention.

In the example illustrated, the receptacle 10 consists in a glass vial having a threaded neck, for example of 27 mm diameter.

The receptacle or the neck may be different without departing from the scope of the invention. In the example illustrated in FIG. 7, the packaging assembly 70 comprises a collection member 20 consisting in an enteral syringe of luer lock type and also an individual package 71 for packaging the assembly.

It is not a departure from the scope of the invention if the packaging 71 comprises, in particular, a plurality of collection members 20.

FIGS. 8 and 9 illustrate steps in a packaging method according to the invention. The step illustrated in FIG. 8 consists in placing the composition L in the receptacle 10. The packaging method then comprises the step illustrated in FIG. 9, consisting in fastening the sealing device 1, particularly, in this example, by screwing on the neck 72 of the receptacle 10.

The packaging method may also comprise the step consisting in associating at least one collection member 20 with the receptacle 10 equipped with the sealing device 1 and in optionally arranging the whole in a totally or partially sterile or non-sterile individual package 71, as illustrated in FIG. 7.

FIGS. 10 to 13 show a method for collecting the composition L using a collection member.

Figure 10:
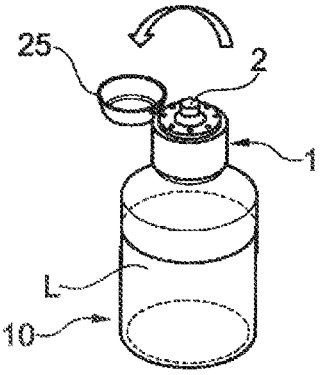
Figure 11:
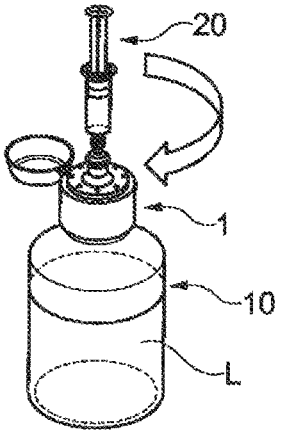
Figure 12:
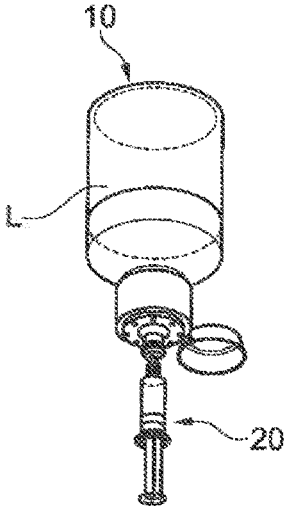

First, the closure member 25 of the sealing device 1 is opened, as illustrated in FIG. 10, and then the collection member 20 is secured to the tip 2, in this example by means of screwing, as illustrated in FIG. 11. Next, by turning the receptacle upside down, the required quantity of composition L is collected with the collection member 20, by drawing on the piston of the collection member as illustrated in FIG. 12.

Figure 13:
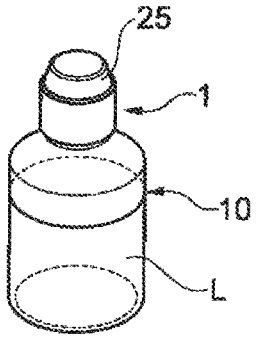

At the time of collection, a reduced pressure is created within the receptacle and the sealing membrane 27 is deformed from its seat. Simultaneously, air penetrates the receptacle 10 via the ports 6, filtered by the filter 7. Lastly, the collection member 20 is removed and, as illustrated in FIG. 13, the closure member 25 is re-closed, the quantity of composition contained in the receptacle 10 having reduced by the quantity collected and being available for one or more subsequent uses, without contamination of the composition L.

Of course, the invention is not limited to the example just described.

In particular, the receptacle may be equipped with a plunger tube and/or have an elastic flexible wall. An additional non-return valve may be positioned near the tip. An additional non-return valve of this type for dry contact may be equipped with a lockable standardized screwable cone specific for enteral administration.

Throughout the description, the expression "comprising a" must be understood as a synonym for "comprising at least one", unless specified to the contrary.

The invention claimed is:

1. A sealing device for collecting a composition intended for enteral or nasal administration or for topical use, contained in a receptacle, comprising:

a tip defining an internal passage leading to an opening designed to allow a connection to a collection member intended for enteral administration, a non-return valve associated with the tip, comprising an annular sealing membrane, and designed to open upon collection of the composition from the receptacle using the collection member and prevent any return of the composition from the collection member into the receptacle when using the collection member to collect the composition, at least one air-return port, and an antibacterial filter associated with the at least one port, and a plate contacting the interior of the receptacle and having at least one perforation for the passage of liquid and forming the seat of the non-return valve, wherein the annular sealing membrane is positioned on the plate so as to close off the at least one perforation for the passage of liquid.

2. The sealing device of claim 1, wherein the tip has at least in part a substantially conical shape.

3. The sealing device of claim 2, wherein the tip has at least in part a substantially conical shape with an approximately 6% taper and is configured as a standardized lockable screwable cone or a Luer Lock cone.

4. The sealing device of claim 1, wherein the non-return valve comprises an annular reduction to allow its deformation.

5. The sealing device of claim 1, wherein the filter is made from a hydrophobic material having a mean pore diameter below 0.3 μm.

6. The sealing device of claim 1, wherein the plate comprises at least one perforation for the passage of air.

7. The sealing device of claim 6, wherein the filter covers the at least one perforation for the passage of air and is affixed to the plate.

8. The sealing device according to claim 1, further comprising means for fastening on the receptacle, the fastening means comprising a fastening skirt, with an internal thread, arranged in order to be affixed to a neck of the receptacle.

9. The sealing device of claim 8, wherein the fastening means comprise a tamper-evident relief designed to prevent removal of the sealing device from the receptacle once the latter has been secured to the receptacle.

10. The sealing device of claim 1, further comprising a closure member connected to the remainder of the sealing device by a flexible link, the closure member configured to be equipped with a tamper-evident system.

11. The sealing device of claim 1, further comprising a base comprising an upper part and a lower part assembled together.

12. The sealing device of claim 11, wherein the upper part comprises the tip and the at least one port, and the lower part comprises the plate.

13. The sealing device of claim 11, wherein the upper part comprises, on an internal face, a sealing skirt designed to bear on the non-return valve.

14. A packaging assembly for a composition intended for enteral administration or for topical use, allowing collection thereof, comprising a receptacle for packaging the composition, secured with the sealing device of claim 1.

15. The assembly of claim 14, further comprising at least one collection member.

16. The assembly of claim 14, packaged in an individual sterile or non-sterile packaging.

17. A method for collecting a composition using a collection member in a receptacle equipped with the sealing device of claim 1, the method comprising:

securing the collection member to the tip;

collecting a required quantity of composition with the collection member, using a piston;

removing the collection member from the tip; and optionally repeating the above steps.

18. The method of claim 17, wherein:

the sealing device comprises a closure member; and the method comprises opening the closure member before securing the collection member to the tip and closing the closure member after removal of the collection member.

19. A method for packaging a composition intended for enteral administration or for topical use in a receptacle, comprising:

placing the composition in the receptacle; and fastening a sealing device according to claim 1 to the receptacle.

20. The method of claim 19, further comprising associating with the receptacle at least one collection member, and providing the whole in an individual sterile or non-sterile packaging.

* * * * *